US008639171B2

(12) United States Patent
Yonekawa et al.

(10) Patent No.: US 8,639,171 B2
(45) Date of Patent: Jan. 28, 2014

(54) FIXING DEVICE AND IMAGE FORMING APPARATUS WITH A MECHANISM TO EXTEND A LIFE OF A FIXING BELT

(75) Inventors: Noboru Yonekawa, Toyohashi (JP); Mamoru Fukaya, Nagoya (JP); Naoki Yamamoto, Toyohashi (JP); Toru Hayase, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 224 days.

(21) Appl. No.: 13/112,344

(22) Filed: May 20, 2011

(65) Prior Publication Data

US 2011/0299902 A1 Dec. 8, 2011

(30) Foreign Application Priority Data

Jun. 3, 2010 (JP) ..... 2010-127574

(51) Int. Cl.
*G03G 15/20* (2006.01)

(52) U.S. Cl.
USPC ..... 399/329; 399/333

(58) Field of Classification Search
USPC ..... 399/329, 333
See application file for complete search history.

(56) References Cited

U.S. PATENT DOCUMENTS

| | | | | |
|---|---|---|---|---|
| 5,257,078 | A | | 10/1993 | Kuroda |
| 5,483,331 | A | * | 1/1996 | Wayman et al. |
| 5,541,719 | A | | 7/1996 | Tamaki |
| 5,722,025 | A | | 2/1998 | Morigami et al. |
| 7,024,146 | B2 | | 4/2006 | Kim et al. |
| 8,165,485 | B2 | | 4/2012 | Asakura et al. |
| 8,346,148 | B2 | | 1/2013 | Yonekawa et al. |
| 2009/0169231 | A1 | | 7/2009 | Asakura et al. |
| 2011/0026990 | A1 | * | 2/2011 | Arimoto ..... 399/333 |
| 2011/0299901 | A1 | | 12/2011 | Yonekawa et al. |
| 2012/0063824 | A1 | | 3/2012 | Schmitt et al. |

FOREIGN PATENT DOCUMENTS

| | | | |
|---|---|---|---|
| CN | 101470392 | | 7/2009 |
| JP | 59155874 | A * | 9/1984 |
| JP | 64-979 | | 1/1989 |
| JP | 5-500435 | | 1/1993 |

(Continued)

OTHER PUBLICATIONS

Notification of Reasons for Refusal mailed Mar. 27, 2012, directed to Japanese Application No. 2010-127576; 7 pages.

(Continued)

*Primary Examiner* — Susan Lee
(74) *Attorney, Agent, or Firm* — Morrison & Foerster LLP

(57) ABSTRACT

A fixing device for thermally fixing an unfixed image formed on a recording sheet by passing the recording sheet through a fixing nip. The fixing device has a heat-generating endless belt that includes: a resistive heat layer that generates heat upon receiving electric current; and a pair of electrode layers each disposed along a different one of widthwise edges of the heat-generating endless belt. The resistive heat layer has (i) reduced thickness portions each along a widthwise edge thereof and (ii) a middle portion between the reduced thickness portions. Each reduced thickness portion is thinner than the middle portion and connected to the middle portion with a wall surface upright in a direction perpendicular to the rotation axis of the heat-generating endless belt to define a stair shape. Each electrode layer is disposed on the resistive heat layer to be in contact with a corresponding one of the wall surfaces.

8 Claims, 8 Drawing Sheets

(56) References Cited

FOREIGN PATENT DOCUMENTS

| | | | |
|---|---|---|---|
| JP | 6-83224 | | 3/1994 |
| JP | 7-72752 | | 3/1995 |
| JP | 7-244441 | | 9/1995 |
| JP | 7-281549 | | 10/1995 |
| JP | 8-335000 | | 12/1996 |
| JP | 9-96982 | | 4/1997 |
| JP | 9-114295 | | 5/1997 |
| JP | 9-146400 | | 6/1997 |
| JP | 9-305050 | | 11/1997 |
| JP | 11-143286 | | 5/1999 |
| JP | 2001-155844 | | 6/2001 |
| JP | 2006-49088 | | 2/2006 |
| JP | 2007-134083 | | 5/2007 |
| JP | 2007-272223 | | 10/2007 |
| JP | 2008-268354 | | 11/2008 |
| JP | 2009092785 | A * | 4/2009 |
| JP | 2009-109997 | | 5/2009 |
| JP | 2009-157108 | | 7/2009 |
| JP | 2009-251132 | | 10/2009 |
| WO | WO-91/10336 | | 7/1991 |

OTHER PUBLICATIONS

Decision to Grant a Patent mailed Apr. 17, 2012, directed to Japanese Application No. 2010-127575; 5 pages.

Yonekawa et al., Notice of Allowance mailed Sep. 4, 2012, directed to U.S. Appl. No. 13/111,093; 8 pages.

Notification of Reasons for Refusal mailed Mar. 27, 2012, directed to Japanese Application No. 2010-127574; 4 pages.

Yonekawa et al., U.S. Office Action mailed Jun. 6, 2013, directed to U.S. Appl. No. 13/112,325; 8 pages.

The First Office Action mailed Jul. 19, 2013, directed to Chinese Patent Application No. 201110148714.3; 16 pages.

The First Office Action mailed Jul. 19, 2013, directed to Chinese Patent Application No. 20110148610.2; 17 pages.

* cited by examiner

FIXING DEVICE AND IMAGE FORMING APPARATUS WITH A MECHANISM TO EXTEND A LIFE OF A FIXING BELT

This application is based on an application No. 2010-127574 filed in Japan, the contents of which are hereby incorporated by reference.

BACKGROUND OF THE INVENTION (1) Field of the Invention

The present invention relates to a fixing device and an image forming apparatus including the fixing device. In particular, the present invention relates to a technology applicable to a fixing device to extend the life of a fixing belt that is included in the fixing device and that has a resistive heat layer and electrode layers for feeding power to the resistive heat layer.

(2) Description of the Related Art

As disclosed, for example, in JP patent application publication No. 2007-272223, some conventional image forming apparatuses (such as printers) employ a fixing device that generates heat upon receiving electric current directly applied to a fixing belt that includes a resistive heat layer.

Such a fixing device provides an advantage of energy savings over a fixing device employing a halogen heater as a heat source.

FIG. 8 is a sectional view of a fixing belt included in a fixing device having a resistive heat layer.

As shown in the figure, a fixing belt 500 includes a reinforcing layer 555 and a resistive heat layer 556 laminated on the reinforcing layer 555.

On the outer circumferential surface of the resistive heat layer 556, a pair of electrode layers 559 are disposed each along an edge of the resistive heat layer 556. The electrode layers 559 are made of metal material and act as electrodes for receiving power from an external power supply.

On the outer circumferential surface of the resistive heat layer 556, in addition, a releasing layer 557 is disposed between the pair of electrode layers 559 for helping a recording sheet to be smoothly released.

Note that the resistive heat layer 556 is made of a material having high electrical resistance and therefore generates heat due to Joule heating in response to the passage of electric current.

With the above configuration, by placing the electrode layers 559 into contact with a pair of power feeders 570 connected to an external AC power source 580, a potential difference is produced across the edges of the resistive heat layer 556 to cause an electric current to pass through the resistive heat layer 556.

As a result, the resistive heat layer 556 generates heat, which is used for thermally fusing an image onto a recording sheet.

Unfortunately, the fixing belt 500 having the above configuration has been found to cause local overheating as a result of the passage of electric current for a long period of time. The overheating occurs locally at around contact portions 560 where the edge of each electrode layer 559 closer toward the releasing layer 557 contacts the resistive heat layer 556.

Such local overheating accelerates deterioration of the heated portions as compared with other portions, which ends up reducing the life of the fixing belt 500.

The following are believed to be the causes of the local overheating.

That is, due to the tendency to flow into where the resistance is lower, the electric current fed to each electrode layer 559 from a corresponding one of the power feeders 570 flows into the resistive heat layer 556 through a portion closer to the other electrode layer 559.

As a result, the electric current flowing between each electrode layer 559 and the resistive heat layer 556 concentrates mainly at the contact portions 560 where the edge of each electrode layer 559 closer toward the releasing layer 557 contacts the resistive heat layer 556.

The electric current flowing into the resistive heat layer 556 locally through each contact portion 560 is then distributed in the thickness direction of the resistive heat layer 556 and concentrates again at around the other contact portion 560.

As a result, the current density reaches the maximum at the contact portions 560, which results in overheating at the corresponding portions of the resistive heat layer 556.

SUMMARY OF THE INVENTION

The present invention is made in view of the above problems and aims to extend the life of a fixing belt included in a fixing device and in an image forming apparatus using a resistance heat generation mechanism.

In order to achieve the above aim, a first aspect of the present invention provides a fixing device for thermally fixing an unfixed image formed on a recording sheet by passing the recording sheet through a fixing nip. The fixing device has: a heat-generating endless belt that rotatably runs about a rotation axis; a first pressure member disposed inside a running path of the heat-generating endless belt; and a second pressure member disposed to press the endless belt against the first pressure member from outside the running path to form the fixing nip. The heat-generating endless belt includes: a resistive heat layer that generates heat upon having electric current applied thereto; and a pair of electrode layers that receive electric current, each electrode disposed along a different one of widthwise edges of the heat-generating endless belt. The resistive heat layer has (i) reduced thickness portions each along a widthwise edge thereof and (ii) a middle portion between the reduced thickness portions. Each reduced thickness portion is thinner than the middle portion and connected to the middle portion with a wall surface upright in a direction perpendicular to the rotation axis of the heat-generating endless belt to define a stair shape. Each electrode layer is disposed on the resistive heat layer to be in contact with a corresponding one of the wall surfaces.

In order to achieve the above aim, a second aspect of the present invention provides an image forming apparatus including a fixing device for thermally fixing an unfixed image formed on a recording sheet by transporting the recording sheet through a fixing nip. The fixing device has: a heat-generating endless belt that rotatably runs about a rotation axis; a first pressure member disposed inside a running path of the heat-generating endless belt; and a second pressure member disposed to press the endless belt against the first pressure member from outside the running path to form the fixing nip. The heat-generating endless belt includes: a resistive heat layer that generates heat upon having electric current applied thereto; and a pair of electrode layers that receive electric current, each electrode disposed along a different one of widthwise edges of the heat-generating endless belt. The resistive heat layer has (i) reduced thickness portions each along a widthwise edge thereof and (ii) a middle portion between the reduced thickness portions. Each reduced thickness portion is thinner than the middle portion and connected to the middle portion with a wall surface upright in a direction perpendicular to the rotation axis of the heat-generating endless belt to define a stair shape. Each electrode layer is disposed on the resistive heat layer to be in contact with a corresponding one of the wall surfaces.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

The following describes an embodiment in which an image forming apparatus of the present invention is applied to a tandem-type digital color printer (hereinafter, simply "printer").

Figure 1:
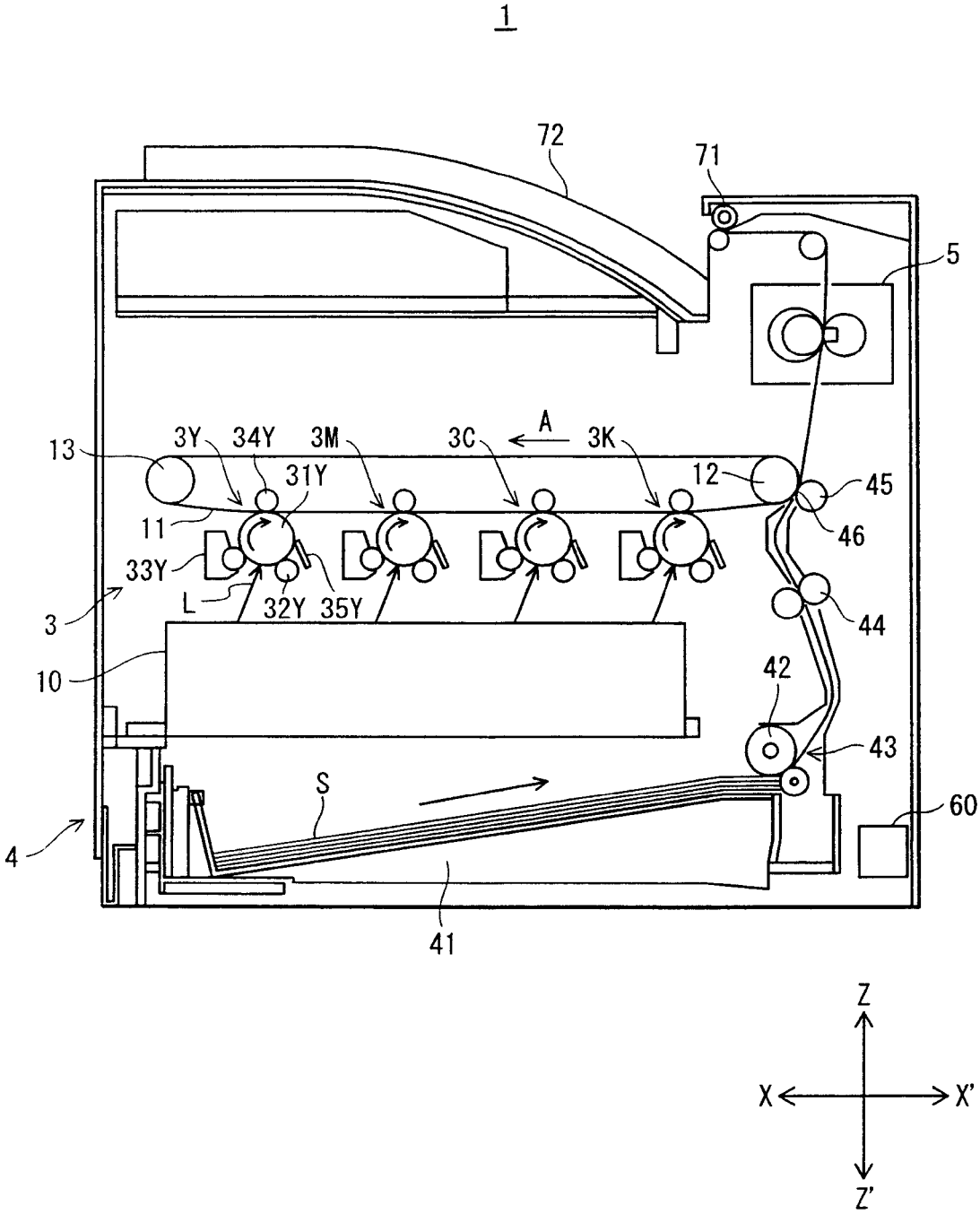
FIG. 1 is a schematic cross-sectional view showing the entire structure of a printer according to an embodiment of the present invention.

FIG. 1 is a schematic cross-sectional view showing the entire structure of a printer 1 according to the embodiment.

As shown in FIG. 1, the printer 1 includes an image processor 3, a sheet feeder 4, a fixing unit 5, and a controller 60. The printer 1 may be connected to a network (such as LAN) to receive instructions for executing a print job from an external terminal device (not shown). Upon receipt of such an instruction, the printer 1 forms toner images of the respective colors of yellow, magenta, cyan, and black, and sequentially transfers the toner images to foam a full-color image.

In the following description, the reproduction colors of yellow, magenta, cyan, and black are denoted as "Y", "M", "C" and "K", respectively, and any structural component related to one of the reproduction colors is denoted by a reference sign attached with an appropriate subscript "Y", "M", "C" or "K".

<Image Processor>

The image processor 3 includes image creating units 3Y, 3M, 3C, and 3K respectively corresponding to the colors Y, M, C, and K, and also includes an optical unit 10 and an intermediate transfer belt 11.

The image creating unit 3Y includes a photoconductive drum 31Y and also includes a charger 32Y, a developer 33Y, a first transfer roller 34Y, and a cleaner 35Y, which are disposed about the photoconductive drum 31Y. The cleaner 35Y is provided for cleaning the photoconductive drum 31Y. The image creating unit 3Y forms a yellow toner image on the photoconductive drum 31Y.

The intermediate transfer belt 11 is an endless belt wound around a drive roller 12 and a passive roller 13 in taut condition to rotatably run in the direction indicated by the arrow "A".

The optical unit 10 includes a light emitting element, such as a laser diode. In accordance with drive signals from the controller 60, the optical unit 10 emits a laser beam L to sequentially scan the surfaces of the photoconductive drums 31Y-31K to form images of the respective colors Y, M, C, and K.

Then, the electrostatic latent images are sequentially developed by the respective developers 33Y-33K to form toner images of colors Y-K on the photoconductive drum 31Y-31K with appropriately adjusted timing. As a result, the process of first transfer is carried out to layer the transferred images on precisely the same position on the surface of the intermediate transfer belt 11.

By the action of the electrostatic force imposed by the first transfer rollers 34Y-34K, the toner images of the respective colors are sequentially transferred onto the intermediate transfer belt 11 to form a full color toner image, which is then carried to a second transfer position 46 by the intermediate transfer belt 11.

The sheet feeder 4 includes: a paper feed cassette 41 for storing recording sheets S; a pickup roller 42 that picks up a recording sheet S from the paper feed cassette 41 one sheet at a time and feeds the recording sheet S onto a transport path 43; and a pair of timing rollers 44 that adjusts the timing to transport the fed recording sheet S to a second transfer position 46.

The recording sheet S having passed through the second transfer position 46 is transported to the fixing unit 5 where heat and pressure is applied to the recording sheet S, so that the toner image (unfixed image) on the recording sheet S is fused and fixed. The recording sheet S then passes between a pair of ejection rollers 71 to be ejected onto an exit tray 72.

<Fixing Unit>

Figure 2:
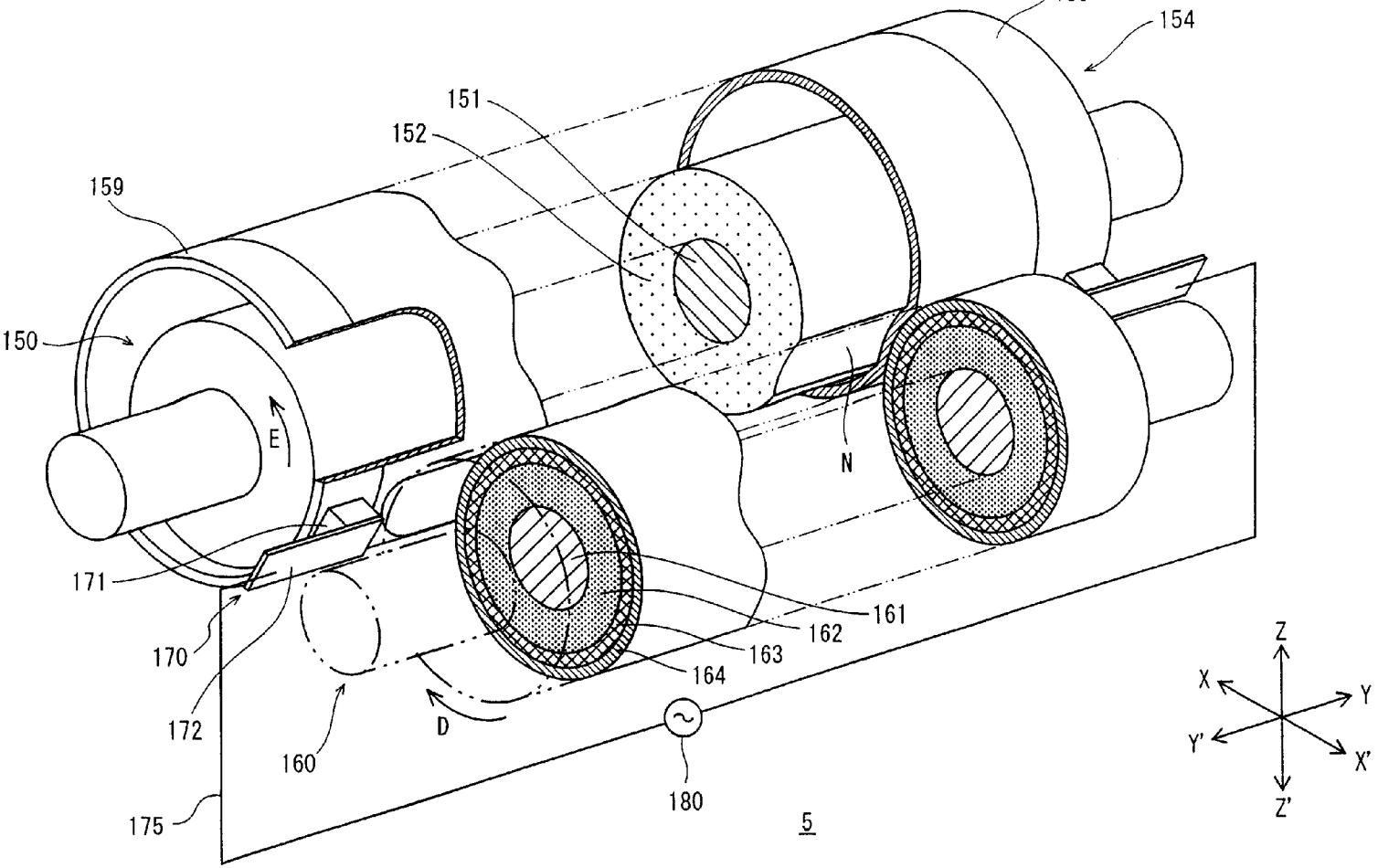
FIG. 2 is a partially broken perspective view of a fixing device according to the embodiment of the present invention.
Figure 3:
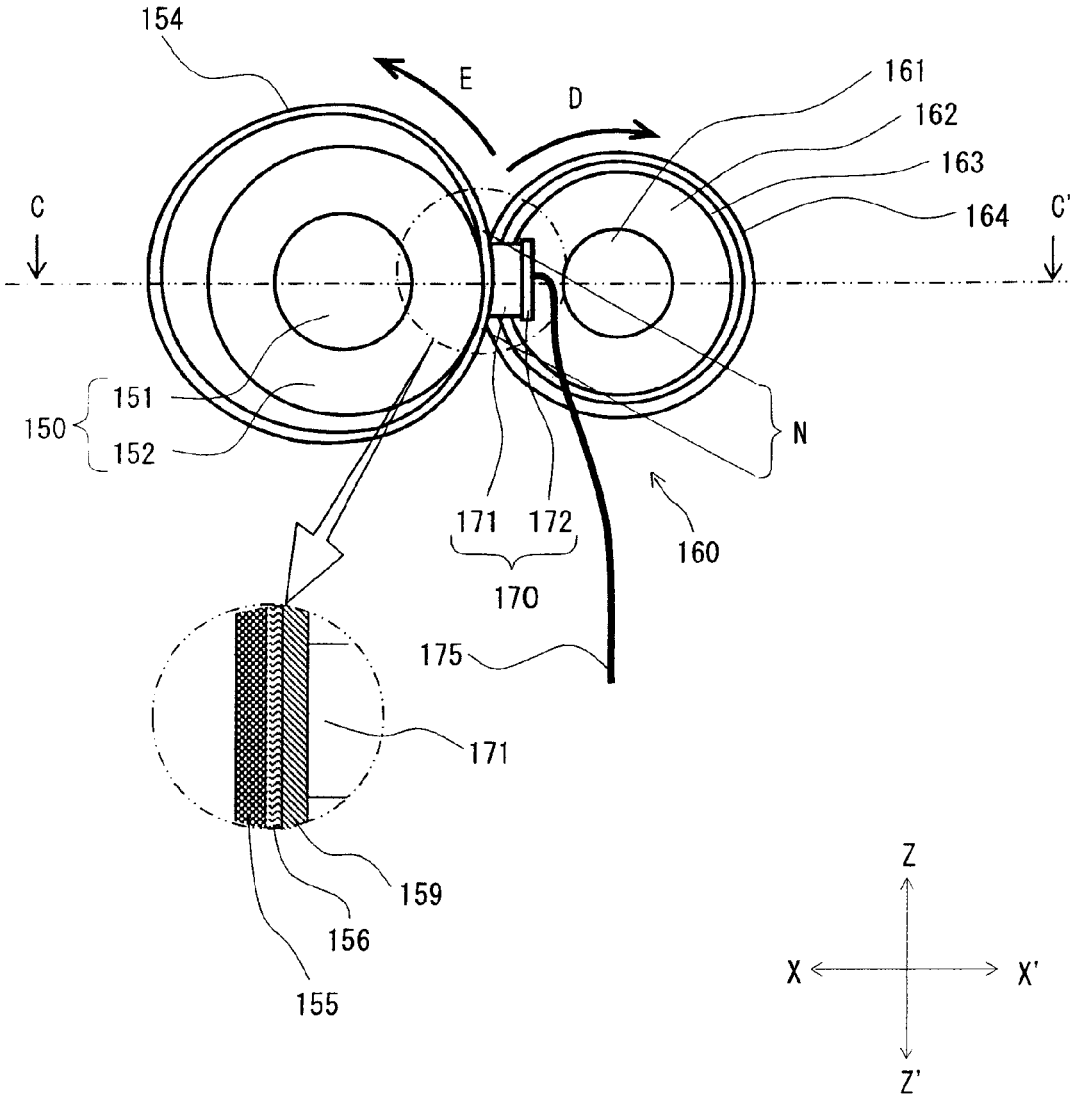
FIG. 3 is a side view of the fixing device according to the embodiment of the present invention.

FIG. 2 is a partially broken, perspective view of the fixing unit 5, whereas FIG. 3 is a side view of the fixing unit 5.

As shown in FIG. 2, the fixing unit 5 includes a fixing belt 154, a pressure roller 150, a pressing roller 160, and a pair of power feeders 170.

The pressure roller 150 is disposed inside the running path of the fixing belt 154 with play (i.e., clearance) relatively to the fixing belt 154.

On the other hand, the pressing roller 160 is disposed outside the running path of the fixing belt 154 and driven by a driving mechanism (not shown) to run in the direction indicated by the arrow D, while pressurizing the pressure roller 150 from outside via the fixing belt 154.

This causes the fixing belt 154 and the pressure roller 150 to rotate passively in the direction indicated by the arrow E, thereby forming a fixing nip N between the pressure roller 150 and the fixing belt 154.

When the recording sheet (not shown) passes through the fixing nip N while the fixing nip N is maintained at a target temperature, heat and pressure is applied to the recording sheet to fuse the unfixed toner image formed on the recording sheet.

The following describes in detail the structure of the fixing unit 5.

<Pressure Roller>

The pressure roller 150 is composed of a cylindrical roller shaft 151 of long dimension and an elastic layer 152 covering the circumferential surface of the roller shaft 151.

The roller shaft 151 is made of, for example, aluminum, iron, or stainless and in the shape of a cylinder that measures approximately 18 mm in outer diameter. The roller shaft 151 is rotatably supported with its axial ends received in bearings that are provided on the main frame (not shown) of the fixing unit 5.

The elastic layer 152 is made of a highly heat-resistant and heat-insulating foamed elastic material, such as a silicone rubber or a fluorine-containing rubber. The thickness of the elastic layer 152 is in the range from 1 mm to 20 mm. Thus the outer diameter of the pressure roller 150 falls in the range from 20 mm to 100 mm. In the present example, the outer diameter of the pressure roller 150 is 5 mm.

The elastic layer 152 is 350 mm long in the Y-axis direction.

<Pressing Roller>

The pressing roller 160 includes a roller shaft 161 and also includes an elastic layer 162, an adhesive layer 163, and a releasing layer 164 that are laminated on the outer circumferential surface of the roller shaft 161 in the stated order.

The roller shaft 161 is, for example, a solid aluminum shaft having an outer diameter of approximately 30 mm and rotated by a driving mechanism (not shown).

The elastic layer 162 is a tubular-shaped silicone rubber which measures 310 mm in the Y-axis direction.

Alternatively to the silicone rubber, the elastic layer 162 may be made of a highly heat-resistant material, such as a fluorine-containing rubber.

The thickness of the elastic layer 162 is preferably in the range from 1 mm to 20 mm, and is 2 mm in the present example.

The releasing layer 164 is formed from a fluorine-containing resin such as polytetrafluoroethylene (PTFE) or tetrafluoroethylene perfluoroalkoxy vinyl ether copolymer (PFA) to have a thickness in the range from 10 μm to 50 μm.

The adhesive layer 163 is made by, for example, applying an adhesive, such as a silicone adhesive, to the surface of the elastic layer 162.

Note that the elastic layer 162, the adhesive layer 163, and the releasing layer 164 are all 310 mm long in the Y-axis direction, which is of course longer than the maximum paper width of any usable recording sheet.

<Power Feeders>

The power feeders 170 are electrically connected to an external power supply 180 via lead wires 175, and disposed in contact with a pair of electrode layers 159 (which will be described later) of the fixing belt 154 to feed power to the electrode layers 159.

The power supply 180 is, for example, a 100 V/50 or 60 Hz commercial power supply.

A relay switch (not shown) is provided in an inserted condition in the lead wires 175. The relay switch goes ON and OFF in accordance with instructions from the controller 60 to allow the electric current to pass through as necessary.

More specifically, each power feeder 170 is composed of a brush 171 and a leaf spring 172.

The brush 171 is a so-called carbon brush, which is made of a lubricating and conductive material, such as copper-graphite or carbon-graphite and has the shape of a rectangular solid that measures, for example, 12 mm in the Y-axis direction, 10 mm in the direction perpendicular to the Y-axis direction, and 15 mm in thickness.

The leaf spring 172 is a rectangular plate made of a conductive and resilient material, such as phosphor bronze or stainless. The leaf spring 172 is fixed at one end to an insulator on the main frame (not shown) of the printer 1, and is bonded at the other end to the brush 171 by, for example, an adhesive having electrical conductivity.

As shown in FIG. 3, the leaf spring 172 constitutes a path to feed power to the brush 171, and presses the brush 171 against the circumferential surface of the corresponding one of the electrode layers 159 (which will be described later) of the fixing belt 154.

<Fixing Belt>

Figure 4:
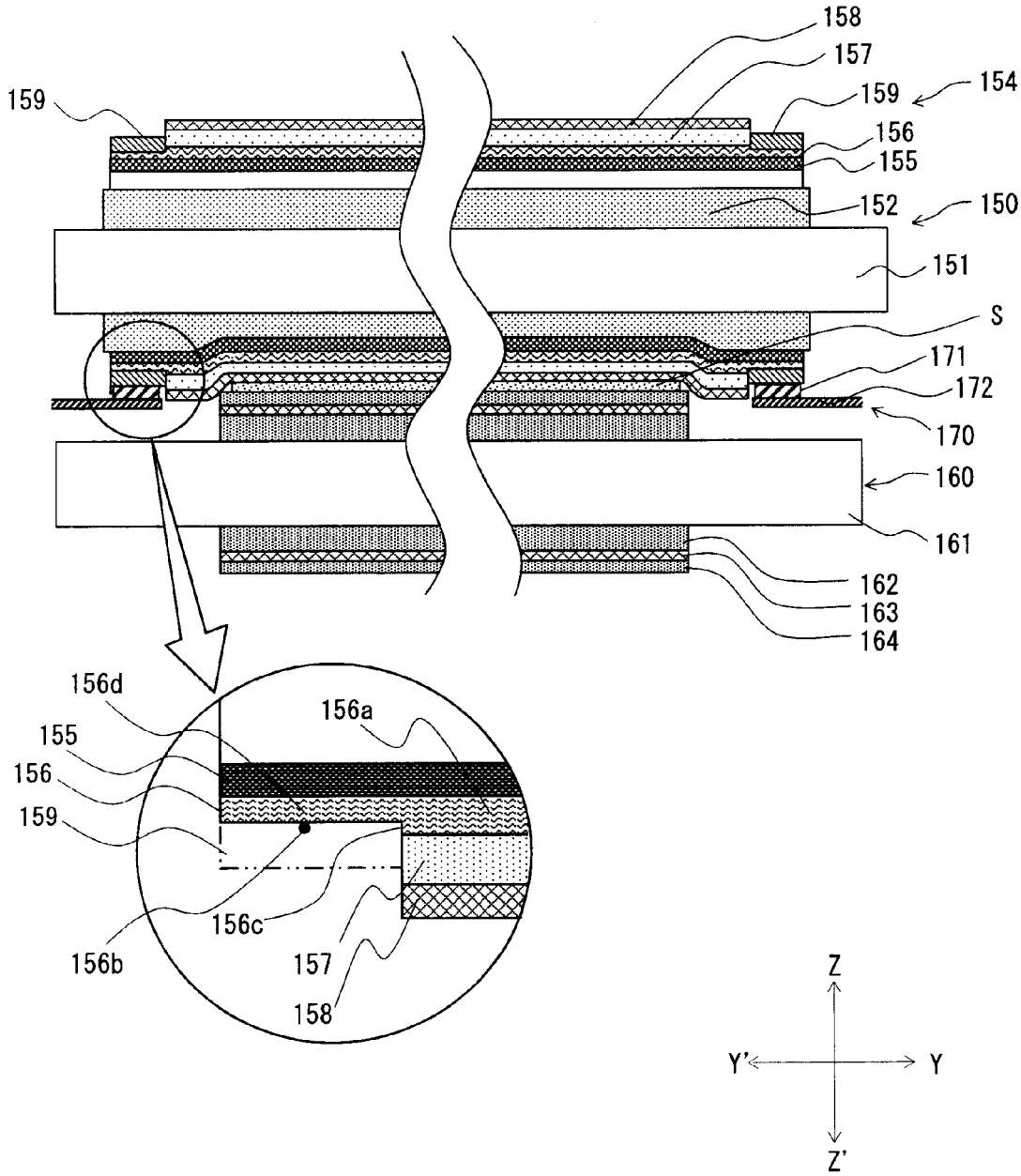
FIG. 4 is an axial sectional view of the fixing device according to the embodiment of the present invention.

FIG. 4 is a sectional view of the fixing device according to the present embodiment, taken along a plane perpendicular to the rotational axis (Y-axis direction) of the pressing roller 160.

The fixing belt 154 is an elastically deformable endless belt having edge portions disposed to flank a middle portion (i.e., the portion other than the edge portions) in the Y-axis direction and the laminated state of the middle portion is different from the edge portions.

More specifically, the fixing belt 154 has a reinforcing layer 155 and a resistive heat layer 156 laminated in the stated order to extend entirely across the width of the fixing belt 154 (i.e., including edge portions and a middle portion between the edge portions in the width direction of the fixing belt).

Note that the resistive heat layer 156 has portions of reduced thickness each along a different one of widthwise edges thereof (i.e., the edges opposing each other in the width direction (Y-axis direction)). More specifically, the thickness of such a portion is reduced in a manner to cut away, in shape, a radially outer portion so as to define the shape of a stair (hereinafter, referred to as a "stair-shape portion **156*b*") on the outer circumferential surface of the resistive heat layer 156**.

Here, a middle portion **156*a* refers to a non-reduced thickness portion of the resistive heat layer 156 located between the two stair-shape portions 156*b* each formed along a widthwise edge of the resistive heat layer 156. In addition, a reduced thickness portion 156*d* refers to each portion thinner than the middle portion 156*a***.

Each electrode layer 159 has an annular shape and is received by a corresponding one of the stair-shape portion **156*b***.

In addition, an elastic layer 157 and a releasing layer 158 are laminated in the stated order on the middle portion **156*a* of the resistive heat layer 156**.

The following describes the configuration of the respective layers of the fixing belt 154 in detail.

The reinforcing layer 155 is made of a non-conductive material, such as polyimide (PI), polyphenylenesulfide (PPS) resin, or polyether ether ketone (PEEK), and its thickness is preferably in the range from 5 μm to 200 μm, and in the present example, it is set to 70 μm.

The electrode layers 159 disposed on the fixing belt 154 are spaced apart in the Y-axis direction and in contact with a corresponding one of the power feeders 170 to supply power to the resistive heat layer 156.

As described above, each electrode layer 159 is disposed to be received by a corresponding one of the stair-shape portions **156*b*. In other words, each electrode layer 159 sits on a corresponding one of the reduced thickness portions 156*d* so as to be in contact with a wall surface 156*c* (a portion upright in the Z direction) connecting the reduced thickness portion 156*d* to the middle portion 156*a*. The wall surface 156*c* extends in a direction perpendicular to the rotational axis of the fixing belt 154**.

More specifically, each wall surface **156*c*** extends in a direction perpendicular to the Y-axis direction (i.e., the direction of current flow).

With this configuration, a portion of the resistive heat layer 156 present between the wall surfaces **156*c*** is uniform in length in the Y-axis direction. As a result, the current density of the uniform-length portion is ensured to be uniform, which achieves to prevent a local increase of the current density.

The electrode layers 159 are made, for example, from a material with low electrical resistance, such as Cu, Ni, Ag, Al, Au, Mg, brass, phosphor bronze, or an alloy of the metals mentioned above. The electrode layers 159 are formed by plating, with the material, the outer circumferential surfaces of the stair-shape portions 156*b*, which are formed along the respective widthwise edges. Alternatively, a conductive ink in which one or more of the above mentioned metals are dispersed may be applied to the outer circumferential surfaces of the stair-shape portions 156*b*.

The volume resistivity of the electrode layers 159 is set to be equal to that of the resistive heat layer 156 or less, and preferably falls within the range of $1.0\times10^{-8}$ Ω·m to $1.0\times10^{-4}$ Ω·m.

Note that the difference between the volume resistivity of the electrode layers 159 with the volume resistivity of the resistive heat layer 156 may be relatively small. Even so, by configuring the electrode layers 159 to be relatively thicker and the resistive heat layer 156 to be relatively thinner, the electrode layers 159 are sufficiently usable as electrodes and the resistive heat layer 156 as a heat generating element.

Preferably, each electrode layer 159 is 15 mm long in the Y-axis direction and in the range from 1 μm to 100 μm in thickness. In this example, the thickness is 20 μm.

Note, in addition, that the electrode layers 159 should not be too thin in order to avoid a voltage drop that would occur before the current injected into the electrode layers through portions in contact with the power feeders 170 reaches locations halfway around the outer circumference.

As a result, the electric current in the resistive heat layer 156 would flow only through and near a path defined by connecting the two contact portions located in the edge portions of the fixing belt 154, which ends up narrowing the heat generating area.

In order to avoid undesirable situations described above, the minimum allowable thickness of each electrode layer 159 is determined to be equal to or higher than the height of the individual wall surfaces 156*c*.

By applying potential difference across the pair of electrode layers 159, the resistive heat layer 156 generates heat due to Joule heating responsive to electric current flowing through in the Y-axis direction.

More specifically, the thickness of the resistive heat layer 156 measures 40 μm at the middle portion 156*a*, and 20 μm at each reduced thickness portion 156*d*. In addition, the resistive heat layer 156 is formed, for example, by coating a solvent prepared by dispersing one or more conductive fillers mutually different in electrical resistance, in a polyimide (PI) resin.

The middle portion 156*a* of the resistive heat layer 156 measures 320 mm in the Y-axis direction, whereas each reduced thickness portion 156*d* measures 15 mm in the Y-axis direction.

Although heat-resistant insulating resins, such as PPS and PEEK, other than PI may be usable as a base material for forming the resistive heat layer 156, PI is preferable as it has the highest heat resistance.

Preferable examples of the conductive fillers include: metals, such as Ag, Cu, Al, Mg and Ni; carbon-based powder materials, such as carbon nanotube and carbon nanofiber; and high-ion conductive powder materials, such as silver iodide and copper iodide, present in inorganic compounds.

Preferably, the electrically conductive fillers are in a fibrous state to ensure that the conductive fillers to make more contact per unit content and the base material permeates into the conductive fillers more easily.

In one example, the stair-shape portions 156*b* are formed by preparing a layer of a uniform thickness from the above-mentioned base material in which conductive fillers are dispersed, followed by chemically or mechanically grinding the edge portions of the layer to an appropriate thickness.

Among the above-mentioned constituents of conductive fillers, each metal has a positive temperature coefficient (PTC) so that the volume resistance of the metal increases with an increase in temperature. On the other hand, each carbon-based powder material and high-ion conductive powder material has a negative temperature coefficient (NTC) so that the volume resistance of the powder decreases with a decrease in temperature. By mixing those constituents having opposite properties at an appropriate ratio, the resulting fillers exhibit a desired volume resistance.

Note that the base material may additionally include a filler other than those mentioned above, in order to improve the mechanical strength and/or thermal conductivity of the resistive heat layer 156.

On condition that the power supply 180 is a commercial power supply as mentioned above, the volume resistance preferably falls within the range from $1.0\times10^{-6}$ to $1.0\times10^{-2}$ Ω·m in order to achieve an intended heating value. More preferably, in view of the configuration of the fixing unit 5 according to the present embodiment, the volume resistance preferably falls within the range from $1.0\times10^{-5}$ to $5.0\times10^{-3}$ Ω·m.

The elastic layer 157 is made from, for example, an elastic and heat-resisting material such as silicone rubber and about 200 μm thick.

Alternatively to the silicone rubber, the elastic layer 157 may be made from, for example, a fluorine-containing rubber.

The releasing layer 158 is made from a material having releasability, typified by a fluorine-containing resin, such as PTFE or PFA, and its thickness is in the range from 5 μm to 100 μm.

As described above, in the fixing unit 5 according to the embodiment, the resistive heat layer 156 has the reduced thickness portions 156*d* each along a widthwise edge thereof and the middle portion 156*a* having a non-reduced thickness between the reduced thickness portions 156*d*. Each reduced thickness portion 156*d* is connected to the middle portion with the wall surface 156*c* that is upright in the direction perpendicular to the rotational axis of the fixing belt 154. At each widthwise edge of the resistive heat layer 156, the reduced thickness portion 156*d* and the wall surface 156*c* together define the stair-shape portion 156*b*. Each electrode layer 156 is laminated on the resistive heat layer 156 and in contact with one of the wall surfaces 156*c*.

<Confirmation of Improved Temperature Distribution>

In a conventional fixing device, electrode layers are disposed on a resistive heat layer having a uniform thickness. In contrast, in the fixing device according to the embodiment, the electrode layers 159, which have a smaller volume resistivity than the resistive heat layer 156, are each disposed in contact with the wall surface 156*c* of one of the stair-shape portion 156*b*.

Figure 5A:
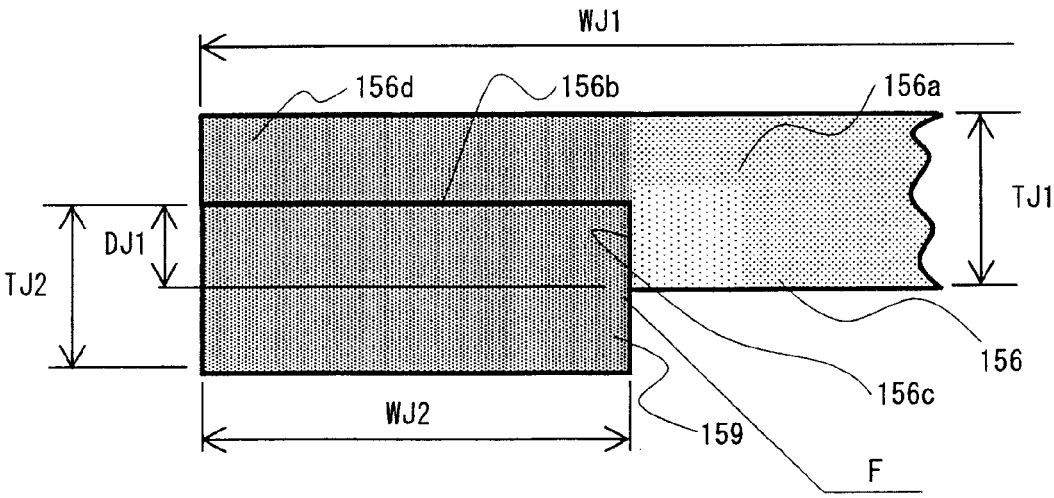
FIGS. 5A and 5B are views illustrating the temperature reduction achieved at overheating portions of a fixing belt according to the embodiment of the present invention.

FIG. 5A is a view of an edge portion (Y'-axis edge portion) of the fixing belt 154 included in the fixing unit 5 configured as described above according to the embodiment, to show a simulated temperature distribution across the electrode layers 159 and the resistive heat layer 156.

Figure 5B:
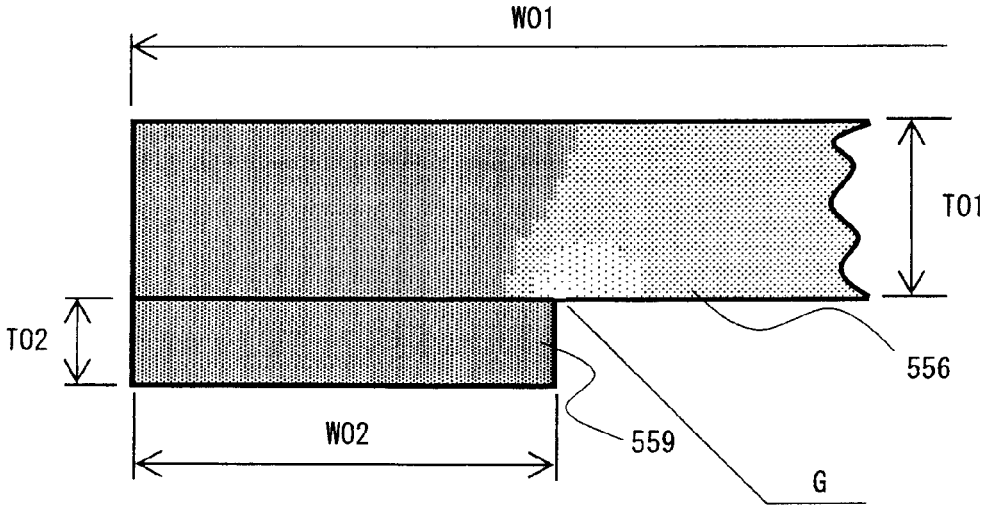

FIG. 5B is a view of an edge portion (Y'-axis edge portion) of the conventional fixing belt 500, to show a simulated temperature distribution across the electrode layer 559 and the resistive heat layer 556.

In the simulation, a model containing only the electrode layer 159 the resistive heat layer 156 is used.

In the figure, darker colors represent lower temperatures, whereas lighter colors represent higher temperatures.

<Simulation Conditions>

Volume resistivity of resistive heat layer: $9.4\times10^{-5}$ Ω·m

Applied voltage: 100 V

Volume resistivity of electrode: $1.72\times10^{8}$ Ω·m

The simulation conditions other than those mentioned above are the same as the fixing belt 154 according to the present embodiment.

<Dimensions>

The dimensions of the portions denoted by the following reference signs in FIGS. 5A and 5B are as follows.

Present Embodiment

WJ1: 340 mm (width in Y-axis direction)

WJ2: 15 mm

DJ1: 20 μm

TJ1: 40 μm

TJ2: 40 μm

Conventional Product

WO1: 340 mm (width in Y-axis direction)

WO2: 15 mm

TO1: 40 μm

TO2: 20 μm

As shown in FIG. 5B relating to the conventional product, the temperature of the resistive heat layer 556 is highest along where a ring contact is made with the annular edge G of the electrode layer 559 closer toward the center of the fixing belt.

More specifically, the temperature of the resistive heat layer 556 is 164° C. along the annular edge G and in the range ambient to 148° C. at the central portion located between the two annular edges G (only one of the annular edges G is shown in the figure). That is, there is a large temperature difference of 16° C.

In contrast, as shown in FIG. 5A relating to the embodiment product, the temperature of the resistive heat layer 156 is highest at portions near the annular edge F (which corresponds to the annular edge G) and thus near the wall surface 156*c*. Yet, the highest temperature is lower as compared with the annular edge G of the conventional product.

More specifically, the temperature of the heat resistive layer 156 is 150° C. at the wall surface 156*c* and portions near the annular edge F, and 148° C. at the middle portion 156*a*. That is, the temperature difference with the highest-temperature portion is 2° C., which indicates that the temperature is more uniform across the entire resistive heat layer 156 as compared with the conventional product.

The following is assumed to be the reason for this phenomenon.

That is, in the conventional product, the current flows from the electrode layer 559 to the resistive heat layer 556 mainly through where the annular edge G of the electrode layer 559 contacts the resistive heat layer 556, which leads to increase the current density and thus increase the temperature at a portion in contact with the annular edge G of the electrode layer 559.

It is because electric current tends to flow along paths of least electrical resistance. Regarding the current flowing between the electrode layer 559 and the resistive heat layer 556, the electrical resistance is smaller in a path through the annular edge G of the electrode layer 559 than through the portion where the electrode layer 559 makes surface contact with the resistive heat layer 556 (i.e., without passing through the annular edge G). Therefore, despite the surface contact between the electrode layer 559 and the resistive heat layer 556, the current flow between the electrode layer 559 and the resistive heat layer 556 takes place mostly through the annular edge G On the other hand, the fixing belt 154 according to the embodiment includes the resistive heat layer 156 having the stair-shape portions 156*b* each formed along a widthwise edge thereof. In addition, each electrode layers 159 having a volume resistivity that is smaller than the resistive heat layer 156 is disposed in contact with the wall surface 156*c* of one of the stair-shape portions 156*b*. Each wall surface 156*c* extends in the direction perpendicular to the rotational axis of the fixing belt 154.

With this configuration, part of the resistive heat layer 156 residing between the wall surfaces 156*c* constitutes the shortest path of electric current flow.

Consequently, between each electrode layer 159 and the resistive heat layer 156, the electric current flows mainly through where a surface contact is made between the wall surface 156*c* and the electrode layer 159. That is, the cross sectional area of the path of electric current flow is larger as compared with a conventional technique according to which current flows only through where line contact is made between the surface of the resistive heat layer and one of the edge portions of each electrode layer closer toward the sheet passing area.

As a result, the current density is decreased and thus the risk of local heating is reduced, which is effective to extend the life of the fixing belt 154.

Figure 6:
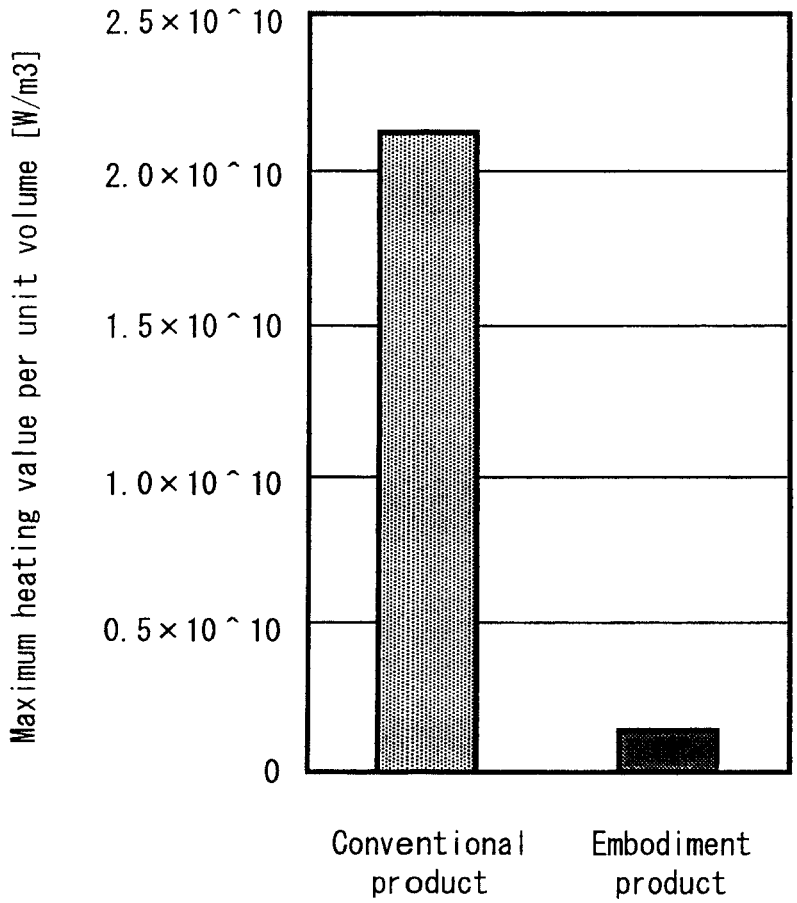
FIG. 6 is a graph of the temperature reduction achieved at overheating portions of the fixing belt according to the embodiment of the present invention.

FIG. 6 is a graph of the simulated maximum heating values per unit volume of the respective resistive heat layers according to the conventional product and the present embodiment.

As shown in the figure, the maximum heating value per unit volume exhibited by the product of the present embodiment is only about 1/15 of the conventional product.

Normally, the fusing temperature is set to fall within the range ambient to 160° C., and the heat-resistant temperature required for the fixing belt 154 is up to 240° C.

Therefore, it is required that the highest temperature measured at any location within the fixing belt 154 be 240° C. or lower.

In addition, the life of the fixing belt 154 is expected to be shorter at portions where temperatures are higher. Then, there is a risk of cracks running from a location having reached the end of its useful life.

In order to prevent such undesirable situations, it is required that the temperatures be uniform throughout the fixing belt 154, i.e., the temperature at any portion of the fixing belt 154 be not locally high.

The fixing belt 154 according to the present embodiment is configured such that the highest temperature measured at any location within the fixing belt 154 is 240° C. or lower, while the overall temperature of the fixing belt 154 is lower and more uniform than a conventional fixing belt. Therefore, the present embodiment extends the life of the fixing belt and prevents or at least reduces thermal deformation.

<Modifications>

The present invention is not limited to the specific embodiment described above and various modifications including the following may be made.

(1) According to the embodiment described above, the fixing belt 154 includes the reinforcing layer 155, the resistive heat layer 156, the elastic layer 157, the releasing layer 158, and the electrode layers 159. However, this description is given merely by way of example and without limitation. It is sufficient that the fixing belt at least includes the resistive heat layer 156 and the electrode layers 159.

For example, in the case of a monochrome copier, the fixing nip may be smaller in width without adversely affecting the fixing quality much, as compared with the case of a color copier. For this reason, the fixing belt 154 for a monochrome copier may be configured without the elastic layer 157.

(2) According to the embodiment described above, in addition, the thickness of the resistive heat layer 156 measures 40 μm at the middle portion 156*a*, and 20 μm at each reduced thickness portion 156*d*. However, this description is given merely by way of example and without limitation.

Conventionally, it is said practically desirable that the middle portion 156*a* of the resistive heat layer 156 measures within the range of 5 μm and 100 μm, since the thickness of the middle portion 156*a* serves as a parameter for setting the amount of heat to be generated.

However, it should be noted that the thickness of each reduced thickness portion 156*d* needs to be smaller correspondingly to the thickness of the middle portion 156*a*. With the middle portion 156*a* having a thickness almost as thin as the minimum allowable thickness mentioned above, the cross sectional area of the wall surface is correspondingly smaller, which leads to increase the current density. Thus, such a wall surfaces 156*c* tend to undergo overheating.

In view of the above, in order to design the middle portion 156*a* to be relatively thinner within the range up to the minimum allowable thickness, care should be taken to ensure that each stair-shape portion 156*b* has an appropriate thickness (the thickness of the middle portion 156*a*—the thickness of the individual reduced thickness portions 156*d*). Then, the thickness of the middle portion 156*a* can be determined to be larger than the thickness of each stair-shape portion 156*b*.

(3) In the above embodiment, the pressure roller 150 is disposed inside the running path of the fixing belt 154 with play relatively to the fixing belt 154. Alternatively, however, the pressure roller 150 may be disposed without play.

In addition, a fixing roller may be employed in which the pressure roller 150 and the fixing belt 154 are integrated.

More specifically, the outer circumferential surface of the roller shaft may be covered with a roller cover made with a laminate of an elastic layer, a resistive heat layer, an electrode layer, a releasing layer, and so on.

Alternatively, the fixing belt 154 may be wound around first and second rollers in taut condition.

In this modification, the first roller may be a pressure roller that cooperates with the pressing roller to form a fixing nip, whereas the second roller may be a roller for setting the length of the fixing belt 154.

With the above configuration, a reduction in outer diameter of the pressure roller improves the releasability of recording sheets. In addition, an increase in the length of the fixing belt 154 reduces the number of rotation per unit time, which leads to the reduction of friction and thus to a longer life of the fixing belt 154.

(4) In the above embodiment, each power feeder 170 is provided with the block-shaped brush 171 that slides over the electrode layer 159 of the fixing belt 154. Alternatively, however, each power feeder 170 may be provided with a metal roller instead of the brush 171 to keep electric contact with the electrode layer 159, while reducing the friction with the electrode layer.

Figure 7:
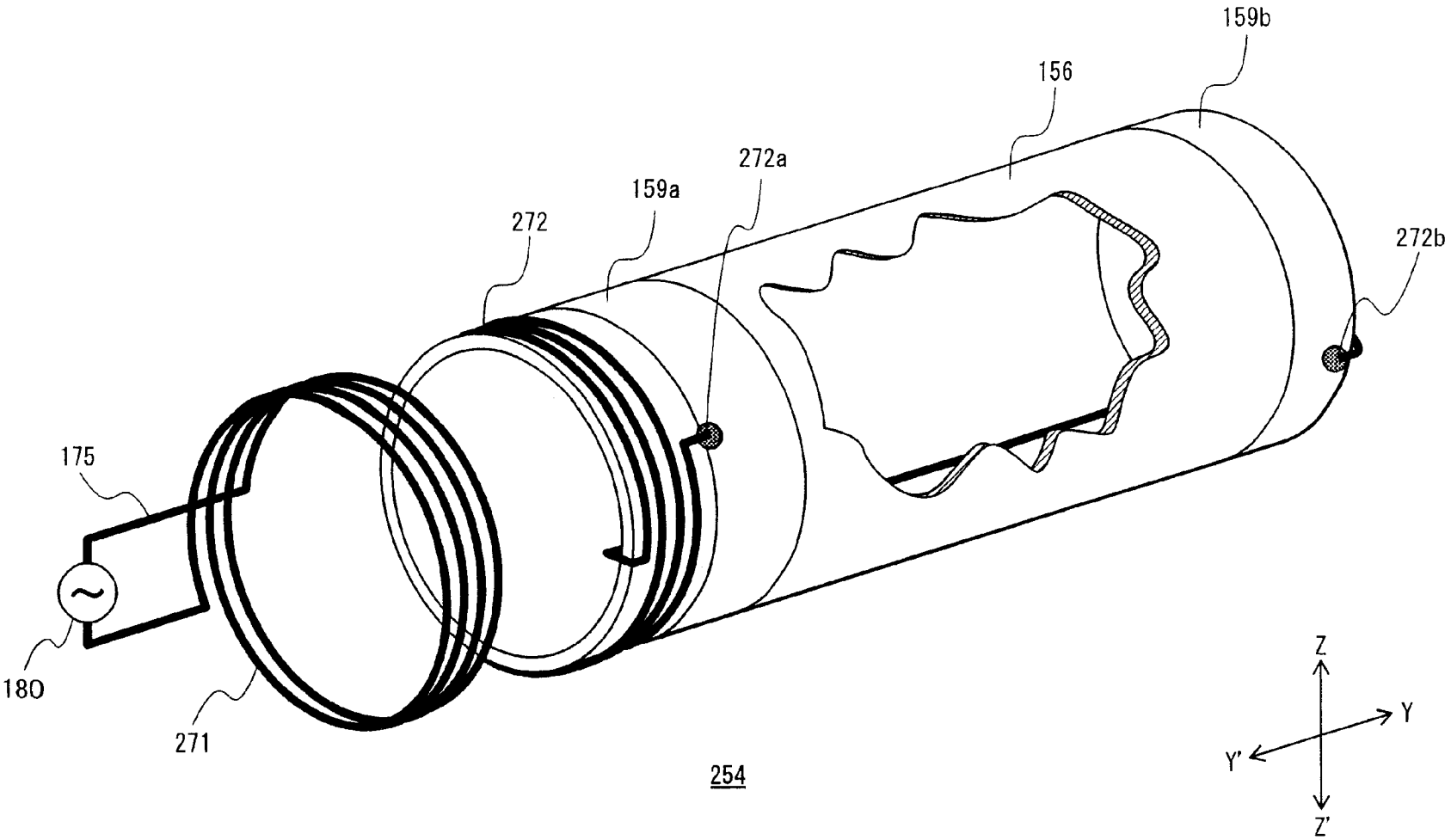
FIG. 7 is a view of a fixing device according to another modification of the present invention.
Figure 8:
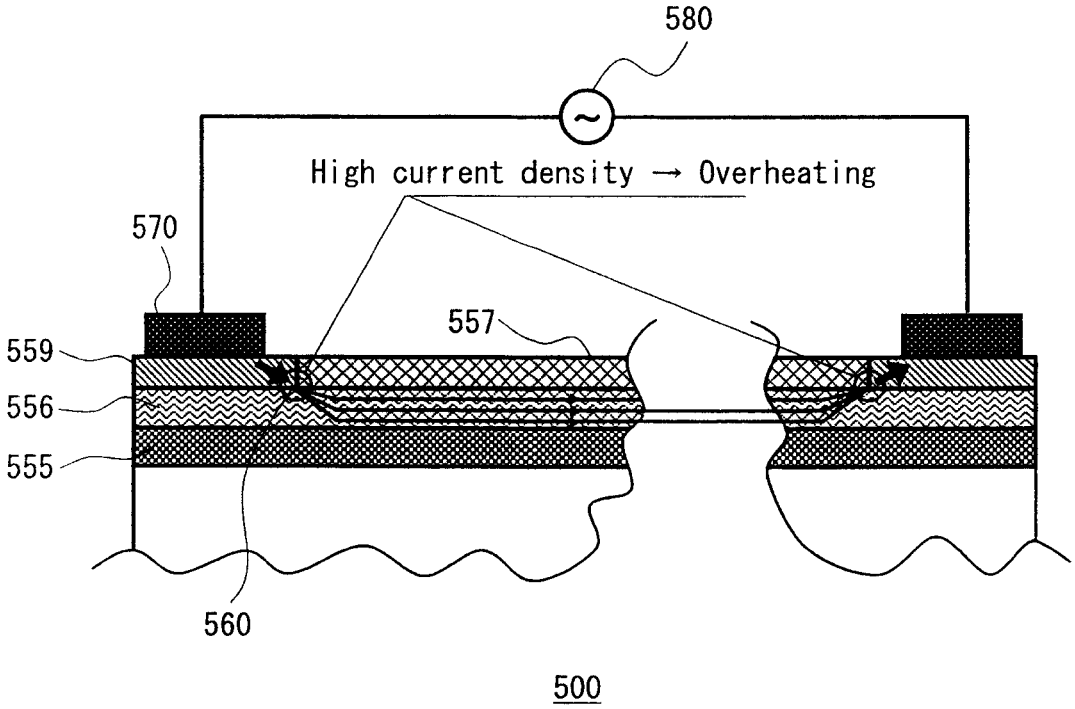
FIG. 8 Prior Art
FIG. 8 is a sectional view of a conventional fixing belt.

In a modification 5 shown in FIG. 7, a primary coil 271 connected to the power supply 180 is disposed on the main body of the fixing device, whereas a secondary coil 272 is wound around an edge of the fixing belt 254. The secondary coil 272 is connected at one end 272*a* to the electrode layer 159*a*, and to the electrode layer 159*b* at another end 272*b*. An AC current is supplied to the primary coil 271 being opposed to the secondary coil 272, so that an electric current is induced in the secondary coil to supply electric power to the electrode layers 159*a* and 159*b* in a non-contact manner.

(5) According to the above embodiment, a material having PTC and a material having NTC are mixed at an appropriate ratio to obtain conducive fillers to exhibit a desired volume resistance. In addition, the ratio may be adjusted for any other purpose.

For example, consider the case where a number of small-size recording sheets are successively printed. In this case, the temperature of the fixing belt 154 tends to be higher at the edge portions where no recording sheets pass (sheet non-passing areas) because no heat is transferred to such recording sheets. In view of this, a fixing belt may be configured with conductive fillers having high content NTC content at the edge portions, so that the temperature rise at sheet non-passing areas is reduced.

Generally, the sheet non-passing areas are located in contact with or near an electrode layer. Therefore, the current density locally increases at portions near the boundary between the electrode layer and the resistive heat layer to raise the temperature. Consequently, the volume resistivity decreases, which leads to an effect of reducing the heating.

The fixing belt 154 according to the above embodiment is configured not to cause an increase in current density at the boundary portions. Therefore, the heating at the boundary portions are duly suppressed, without requiring that the sheet non-passing areas be high in content of conductive filler with a high NTC content.

(6) According to the present embodiment, the electrode layers 159 are each in an annular form that surrounds the fixing belt 154 in a circumferential direction. However, this description is given merely by way of example and without limitation. For example, each of the electrode layers 159 may have at least one slit non-orthogonal or in parallel to the axis of the pressure roller 150.

In this modification, the locations of the power feeder 170 or the number of slits provided may be optimized to heat only part of the fixing belt 154 relevant to the formation of the fixing nip N, which leads to power savings.

(7) In the above embodiment, the electrode layers 159 are disposed outside the running path of the fixing belt 154. Alternatively, however, the electrode layers 159 may be disposed inside the running path of the fixing belt 154.

In this modification, it is naturally appreciated that each stair-shape portion 156*b* of the resistive heat layer 156 needs to be formed on the inner circumferential surface of the resistive heat layer 156 and the electrode layers 159 need to be disposed to be received by the stair-shape portion 156*b*.

Further, it is naturally appreciated that each power feeder 170 needs to be disposed inside the running path of the fixing belt 154 to be in contact with a corresponding one of the electrode layers 159.

In addition, it is preferable that the relation between the pressure roller 150 and the pressing roller 160 are reversed in terms of axial lengths, so that the power feeders 170 press the electrode layers 159 against the outer circumferential surface of the pressing roller 160.

(8) In the above embodiment, the power feeders 170 are disposed at locations that would meet the fixing nip N if extended in the axial direction. This disposition is to avoid the fixing belt 154 from being displaced backward when the feeders 170 come to press the electrode layers 154.

In one modification, one or more regulating plates may be provided inside the running path of the fixing belt 154 to retain the running path of the fixing belt 154. Then, each power feeder 170 is disposed outside the running path of the fixing belt 154 at a location opposite the regulating plate. With this configuration, the fixing belt 154 is kept on the running path without being retracted backward, even when the power feeders 170 are pressed against the electrode layers 154*a* and 159*b*. Consequently, the electrodes are reliably maintained in contact with the fixing belt 154.

(9) According to the above embodiment, the components, namely the pressure roller 150 and the pressing roller 160, that are disposed to sandwich the fixing belt 154 to foam a fixing nip are both rotatable bodies. Alternatively, however, only one of the components may be a rotatable body and the other component may be a non-rotatable, fixed body as long as the other component cooperates with the rotatable body to apply pressure to the fixing belt 154.

One example of such a member is a member of long dimension in a direction perpendicular to the running direction of the fixing belt 154 having a highly smooth surface.

In short, any member, such as a rotatable body or a fixed member of long dimension, is usable as long as the member is usable to apply pressure.

(10) In the above embodiment, both the wall surfaces 156*c* of the resistive heat layer 156 are perpendicular to the Y-axis direction, i.e., the direction of the current flow. However, this description is given merely by way of example and without limitation. The wall surfaces 156*c* may not be perpendicular to the Y-axis direction.

Yet, with the inclination of the wall surfaces 156*c* away from the perpendicular state, the difference between the shortest and longest lengths of the resistive heat layer increases in the Y-axis direction. Therefore, it is preferable that the wall surfaces 156*c* are perpendicular to the Y-axis direction.

(11) According to the above embodiment, in addition, each stair-shape portion 156*b* is formed by reducing the thickness of the resistive heat layer 156 by removing a radially outer portion along a widthwise edge of the resistive heat layer 156. Alternatively, however, the stair-shape portions 156*b* may be formed by providing a concaved portion along each widthwise edge of the resistive heat layer 156.

That is, each stair-shape portion 156*b* will have two wall surfaces 156*c*, one connecting to the middle portion 156*a* and the other connecting to a non-reduced thickness edge of the resistive heat layer 159. In this modification, it is sufficient that each electrode layer 159 is disposed in contact with one of the wall faces 156*c* that is closer towered the sheet passing area.

(12) The above embodiment is directed to an example in which the image forming apparatus according to the present invention is applied to a tandem-type digital color printer. However, this description is given merely by way of example and without limitation. The present invention is generally applicable to a fixing device having a pressure member, such as a pressure roller, disposed inside the running path of the fixing belt and a pressing roller pressing the pressure member via the fixing belt, whereby a fixing nip is formed. The present invention is also applicable generally to an image foaming apparatus having such a fixing device.

In addition, any combination of the above embodiment and modifications still falls within the scope of the present invention.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A fixing device for thermally fixing an unfixed image formed on a recording sheet by passing the recording sheet through a fixing nip, the fixing device comprising:

a heat-generating endless belt that rotatably runs about a rotation axis;

a first pressure member disposed inside a running path of the heat-generating endless belt; and a second pressure member disposed to press the endless belt against the first pressure member from outside the running path to form the fixing nip, wherein the heat-generating endless belt includes:

a resistive heat layer that generates heat upon having electric current applied thereto; and a pair of electrode layers that receive electric current, each electrode disposed along a different one of widthwise edges of the heat-generating endless belt, the resistive heat layer has (i) reduced thickness portions each along a widthwise edge thereof and (ii) a middle portion between the reduced thickness portions, each reduced thickness portion being thinner than the middle portion and connected to the middle portion with a wall surface upright in a direction perpendicular to the rotation axis of the heat-generating endless belt to define a stair shape, and each electrode layer is disposed on the resistive heat layer to be in contact with a corresponding one of the wall surfaces, wherein the first pressure member is a cylindrical pressure roller, the heat-generating endless belt is fit with clearance about the first pressure member, and the first pressure member and the heat-generating endless belt rotate following rotation of the second pressure member.

2. The fixing device according to claim 1, wherein each electrode layer has a thickness equal to or greater than a height of the wall surface.

3. The fixing device according to claim 1, wherein the resistive heat layer is made of a heat-resistant insulating resin containing a conductive filler dispersed therein.

4. A fixing device for thermally fixing an unfixed image formed on a recording sheet by passing the recording sheet through a fixing nip, the fixing device comprising:

a heat-generating endless belt that rotatably runs about a rotation axis;

a first pressure member disposed inside a running path of the heat-generating endless belt; and a second pressure member disposed to press the endless belt against the first pressure member from outside the running path to form the fixing nip, wherein the heat-generating endless belt includes:

a resistive heat layer that generates heat upon having electric current applied thereto; and a pair of electrode layers that receive electric current, each electrode disposed along a different one of widthwise edges of the heat-generating endless belt, the resistive heat layer has (i) reduced thickness portions each along a widthwise edge thereof and (ii) a middle portion between the reduced thickness portions, each reduced thickness portion being thinner than the middle portion and connected to the middle portion with a wall surface upright in a direction perpendicular to the rotation axis of the heat-generating endless belt to define a stair shape, and each electrode layer is disposed on the resistive heat layer to be in contact with a corresponding one of the wall surfaces, wherein the first pressure member is a cylindrical roller shaft, the heat-generating endless belt is a roller cover disposed on an outer circumferential surface of the roller shaft, and the roller shaft and the roller cover comprises a single roller.

5. An image forming apparatus including a fixing device for thermally fixing an unfixed image formed on a recording sheet by transporting the recording sheet through a fixing nip, the fixing device comprising:

a heat-generating endless belt that rotatably runs about a rotation axis;

a first pressure member disposed inside a running path of the heat-generating endless belt; and a second pressure member disposed to press the endless belt against the first pressure member from outside the running path to form the fixing nip, wherein the heat-generating endless belt includes:

a resistive heat layer that generates heat upon having electric current applied thereto; and a pair of electrode layers that receive electric current, each electrode disposed along a different one of widthwise edges of the heat-generating endless belt, the resistive heat layer has (i) reduced thickness portions each along a widthwise edge thereof and (ii) a middle portion between the reduced thickness portions, each reduced thickness portion being thinner than the middle portion and connected to the middle portion with a wall surface upright in a direction perpendicular to the rotation axis of the heat-generating endless belt to define a stair shape, and each electrode layer is disposed on the resistive heat layer to be in contact with a corresponding one of the wall surfaces, wherein the first pressure member is a cylindrical pressure roller, the heat-generating endless belt is fit with clearance about the first pressure member, and the first pressure member and the heat-generating endless belt rotate following rotation of the second pressure member.

6. The image forming apparatus according to claim 5, wherein each electrode layer has a thickness equal to or greater than a height of the wall surface.

7. The image forming apparatus according to claim 5, wherein the resistive heat layer is made of a heat-resistant insulating resin containing a conductive filler dispersed therein.

8. An image forming apparatus including a fixing device for thermally fixing an unfixed image formed on a recording sheet by transporting the recording sheet through a fixing nip, the fixing device comprising:

a heat-generating endless belt that rotatably runs about a rotation axis;

a first pressure member disposed inside a running path of the heat-generating endless belt; and a second pressure member disposed to press the endless belt against the first pressure member from outside the running path to form the fixing nip, wherein the heat-generating endless belt includes:

a resistive heat layer that generates heat upon having electric current applied thereto; and a pair of electrode layers that receive electric current, each electrode disposed along a different one of widthwise edges of the heat-generating endless belt, the resistive heat layer has (i) reduced thickness portions each along a widthwise edge thereof and (ii) a middle portion between the reduced thickness portions, each reduced thickness portion being thinner than the middle portion and connected to the middle portion with a wall surface upright in a direction perpendicular to the rotation axis of the heat-generating endless belt to define a stair shape, and each electrode layer is disposed on the resistive heat layer to be in contact with a corresponding one of the wall surfaces, wherein the first pressure member is a cylindrical roller shaft, the heat-generating endless belt is a roller cover disposed on an outer circumferential surface of the roller shaft, and the roller shaft and the roller cover comprises a single roller.

* * * * *